United States Patent [19]

Flynn et al.

[11] Patent Number: 4,563,186

[45] Date of Patent: Jan. 7, 1986

[54] MULTI-FUNCTIONAL LAUNDRY PRODUCT AND EMPLOYMENT OF SAME DURING FABRIC LAUNDERING

[75] Inventors: Brian P. Flynn, Lakewood; Deborah S. Winetzky, Torrance; George D. Evans, Tustin, all of Calif.

[73] Assignee: Purex Corporation, Lakewood, Calif.

[21] Appl. No.: 597,127

[22] Filed: Apr. 5, 1984

[51] Int. Cl.[4] ..... D06M 11/04; C11D 17/00

[52] U.S. Cl. ..... 8/137; 252/90; 252/92; 8/147

[58] Field of Search ..... 252/90, 92; 8/137, 147; 215/6

[56] References Cited

U.S. PATENT DOCUMENTS

| | | | |
|---|---|---|---|
| Re. 14,688 | 7/1919 | Maiden | 215/6 |
| 59,338 | 10/1866 | Bullard | 106/91 |
| D. 100,412 | 7/1936 | Carp | 215/6 |
| 180,132 | 7/1976 | Hoard | 215/6 |
| 360,460 | 4/1887 | Nelson | 206/216 |
| 498,875 | 6/1893 | Becannon | 206/102 |
| 611,008 | 9/1898 | Gerstendorfer | 215/6 |
| 814,503 | 3/1906 | Andressen | 215/6 |
| 815,883 | 3/1906 | Van Blarcom | 222/142.2 |
| 856,064 | 6/1907 | Jackson | 222/142.5 |
| 937,049 | 10/1909 | Callahan | 215/6 |
| 988,031 | 3/1911 | Remy | 215/6 |
| 1,002,293 | 9/1911 | McGrann | 215/6 |
| 1,007,679 | 11/1911 | Ellis | 215/6 |
| 1,127,292 | 2/1915 | Schuyler | 206/237 |
| 1,255,772 | 2/1918 | Miller | 206/226 |
| 1,280,534 | 10/1918 | Penn | 206/237 |
| 1,337,034 | 4/1920 | Bauermeister | 215/230 |
| 1,427,820 | 9/1922 | Kaufman | 206/568 |
| 1,466,593 | 8/1923 | Kirchmer | 206/568 |
| 1,489,993 | 5/1924 | Etheridge | 206/237 |
| 1,583,038 | 5/1926 | Weic | 215/6 |
| 1,609,447 | 12/1926 | Ward | 215/6 |
| 1,657,312 | 1/1928 | McEldowney | 215/6 |
| 1,686,354 | 10/1928 | Wallace | 40/310 |
| 1,742,279 | 1/1930 | Reynolds | 206/218 |
| 1,780,728 | 11/1930 | Webber | 215/6 |
| 1,875,325 | 9/1932 | Bowman | 141/24 |
| 1,904,777 | 4/1933 | Brzezicki | 206/237 |
| 1,912,438 | 6/1933 | Etter | 141/322 |
| 1,913,950 | 6/1933 | Platt | 206/223 |
| 1,918,307 | 7/1933 | Webber | 215/6 |
| 1,918,308 | 7/1933 | Webber | 215/6 |
| 1,922,434 | 8/1933 | Gundlach | 95/5.7 |
| 1,993,978 | 3/1935 | Plochman | 215/6 |
| 2,011,399 | 11/1935 | Driscoll | 206/47 |
| 2,031,381 | 2/1936 | McCallum | 206/47 |
| 2,048,219 | 7/1936 | Putter | 215/6 |
| 2,072,630 | 3/1937 | Ferry | 215/6 |
| 2,086,119 | 7/1937 | Corin | 215/37 |
| 2,276,678 | 3/1942 | Wheeler | 65/13 |
| 2,302,933 | 11/1942 | Barol | 206/46 |
| 2,310,491 | 2/1943 | Molow | 215/33 |
| 2,321,998 | 6/1943 | Crouch | 215/6 |
| 2,334,546 | 11/1943 | Davis | 206/47 |
| 2,352,951 | 7/1944 | Geria | 126/263 |
| 2,362,223 | 11/1944 | Platkin | 215/6 |
| 2,491,663 | 12/1949 | Hultin | 229/37 |
| 2,493,922 | 1/1950 | Miller | 215/6 |
| 2,619,448 | 11/1952 | Larsen | 195/54 |

FOREIGN PATENT DOCUMENTS

| | | |
|---|---|---|
| 996193 | 6/1965 | United Kingdom . |

*Primary Examiner*—Theodore Morris

*Attorney, Agent, or Firm*—William W. Haefliger

[57] ABSTRACT

The invention relates generally to products useful for home laundering, and more particularly to a product which incorporates a prespotter with a detergent and having one or more of the following separate functions: detergency, fabric softening, stain removal, bleaching, and bluing; with the advantage being that both the detergent and the prespotter are uniquely packaged together as one product, negating the need to purchase and store separate products for each end use function, and also, unavoidably providing presentation of the pre-spotter to the detergent user at the time of laundering. The invention also concerns methods of use of such products during laundering.

20 Claims, 18 Drawing Figures

MULTI-FUNCTIONAL LAUNDRY PRODUCT AND EMPLOYMENT OF SAME DURING FABRIC LAUNDERING

BACKGROUND OF THE INVENTION

This invention relates generally to products useful for home laundering, and more particularly to a product which incorporates a prespotter with a detergent and having one or more of the following separate functions: detergency, fabric softening, stain removal, bleaching, and bluing; with the advantage being that both the detergent and the prespotter are uniquely packaged together as one product, negating the need to purchase and store separate products for each end use function, and also, unavoidably providing presentation of the pre-spotter to the detergent user at the time of laundering. Currently, products are available that combine several functions such as detergency/fabric softening, detergency/stain removal, etc. In addition, detergent products often come with use directions suggesting methods for using the product itself as a prespotter for pretreating stains or heavily soiled areas prior to laundering. These products are not nearly as desirable as the product comprising the present invention, which is unique in that it combines a detergent product with an effective self-contained prespotter, all in one package which facilitates storage, handling, use and effectiveness.

SUMMARY OF THE INVENTION

The invention contemplates a prespotter product, either liquid or solid, packaged in a dispensing container. The latter is uniquely combined with the container used to package the laundry detergent in such manner as to facilitate storage, handling and use of both the prespotter and the detergent at the time of laundering. The design is such that the prespotter dispensing container is not only attached to or integral with the detergent container, but can be detached from or otherwise used separately from the detergent product container. Such structural incorporation of the prespotter container into the detergent container is referred to herein as a "fitment", the various unusually advantageous forms of which can best be described by reference to the following drawings and descriptions. Detergent containers useful with the fitment can take the form of bottles or folding cartons as will appear.

The invention also contemplates or enables an improved method for laundering fabric, and which embodies the following steps:

(a) providing a first volume of detergent a portion of which is to be added to fabric laundry wash water, (b) providing a second and smaller volume of a prespotter composition in close transported association with the first volume of detergent for presentation at the time of laundering, (c) and separating some of said prespotter composition from such close association with the detergent volume and applying same to a soiled portion or portions of fabric that is thereafter laundered in the wash water containing said added portion of detergent.

As will appear, the step (c) is typically carried out just prior to addition of the fabric to the wash water at the time of laundering, the user being unavoidably alerted to carry out step (c) by virtue of steps (a) and (b). In addition, the method may be further enabled by the following steps:

(i) providing a container containing said first volume of detergent, (ii) providing a sub-container containing said smaller volume of prespotter composition, and (iii) mounting said sub-container in close transported association with said container. The sub-container may take the unusually advantageous form of the "fitment" referred to, and to be described, as well as their methods of mountings on the principle container.

These and other objects and advantages of the invention, as well as the details of an illustrative embodiment, will be more fully understood from the following description and drawings, in which:

DRAWING DESCRIPTION

DETAILED DESCRIPTION

Figure 1:
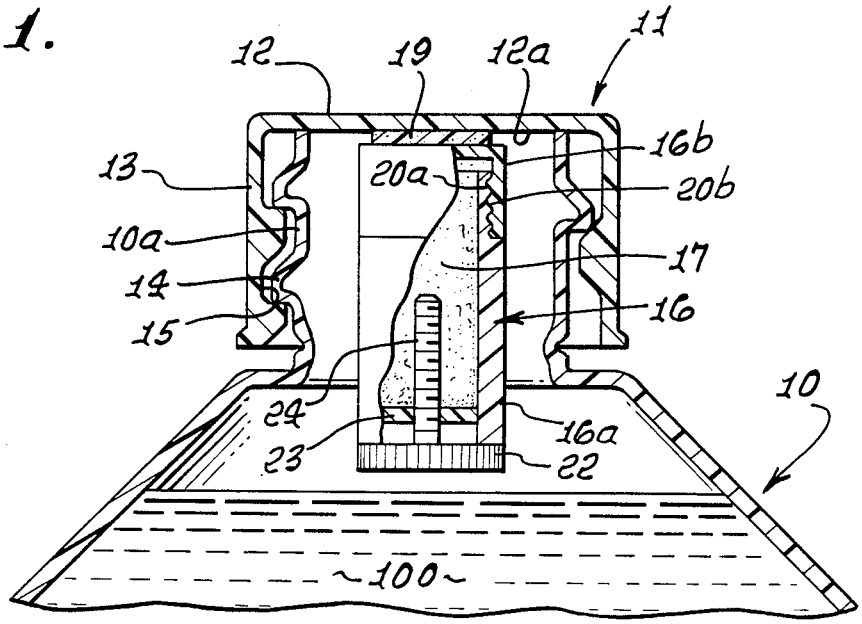
FIG. 1 is a vertical section showing a fitment adhered to the underside of a bottle overcap.

Referring first to the drawings, FIG. 1 illustrates a first container in the form of a bottle 10 having a threaded neck 10*a*, the bottle containing flowable detergent 100 (as per example liquid detergent or flowable dry granules). The bottle has a removable cap 11 which in turn has a top horizontal wall 12 overlying the neck 10*a*, and a depending skirt 13 that extends in interfitting section with the neck. As shown, the skirt and neck have interfitting screw threads 14 and 15, other type connections being usable. The bottle, neck and cap may all consists of usable plastic material.

Also provided is a dispensing container as defined by fitment 16 containing a fabric prespotter composition 17. The fitment is indirectly carried by the bottle 10, and directly by the cap 11, to be readily detachable, at least in part, for dispensing the prespotter composition onto fabric as at the time of fabric laundering. Thus, for example, removal of the cap 10 to provide access to the detergent immediately presents the user with the fitment projecting from the removed cap, reminding the user that the fitment is ready to be used for application of prespotting composition to heavily soiled portions of the fabric, as at the precise time of laundering and in conjunction therewith, to obtain a resulting higher quality cleaning of the fabric.

As shown, the fitment has a sub-container 16*a* and a sub-container cap 16*b*, the latter being retained by the top wall 12, and specifically to its underside 12*a* as by means of adhesive, double tape, VELCRO stripping, or other means, each of which is represented by the layer 19. In use, the sub-container 16*a* may be removed from the cap, as by reverse rotation to unscrew threads 20*a* and 20*b*. The prespotter stick carried by sub-container 16*a* is then exposed for use. Note that the stick may be suitably advanced from the sub-container as by rotation of rotor 22 which serves to advance plunger 23 on a threaded stem 24. Other advancing means may be provided. The prespotter 17 may comprise a stick (as in U.S. Pat. No. 3,953,353) or a liquid, or a composition as defined subsequently herein.

The dispensing device itself can be made from plastic, glass, metal or other suitable material for holding a liquid or a solid. For a liquid prespotter, the product can delivered to the pretreatment area by a number of means including aerosol spray, pump spray, roll-on, squeeze bottle with suitable dispensing cap, etc. A solid prespotter can be packaged as described above in a push-up or screw-up container allowing the user to rub the prespotter solid on the pretreatment area and expose fresh material as needed.

The detergent container can be made from any suitable material including polyethylene, polypropylene, PVC and other plastics, glass, metal, or paperboard. In the case of paperboard, a suitable moisture barrier would be advantageous to maintain the product's effectiveness during storage and use.

Figure 2:
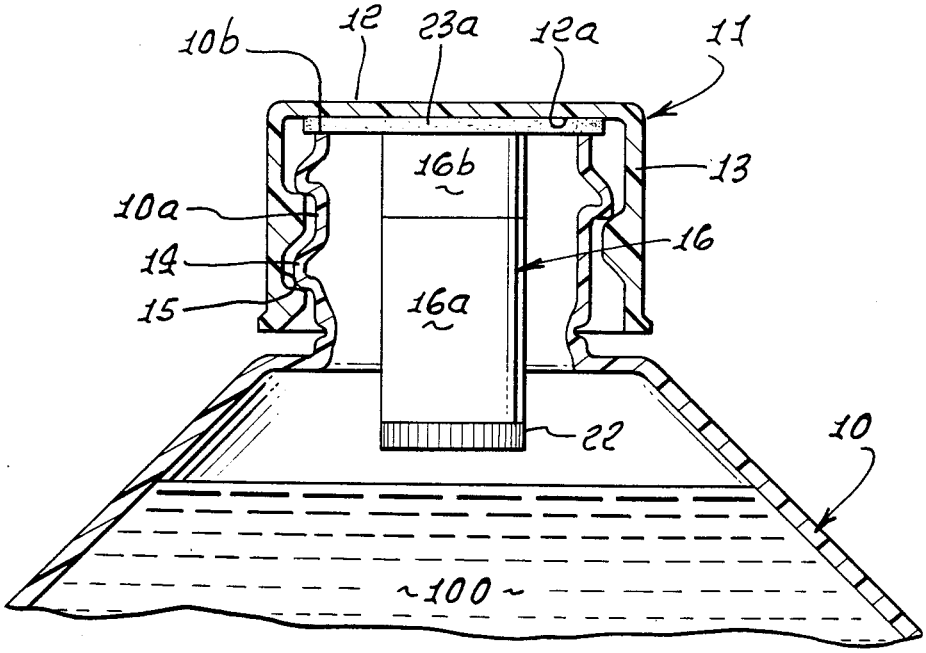
FIG. 2 is a vertical section showing a fitment cap seated on the bottle finish.

In FIG. 2, the elements bearing the same numbers as in FIG. 1 are the same. The fitment cap 16*b* in addition has a radially projecting flange 23*a* extending over the rim 10*b* of the bottle neck 10*a* and retained on that rim by the underside 12*a* of the bottle cap 11. Thus, the fitment 16 is completely detachable from the cap 11 when the bottle is removed from the neck 10*a*.

Figure 3:
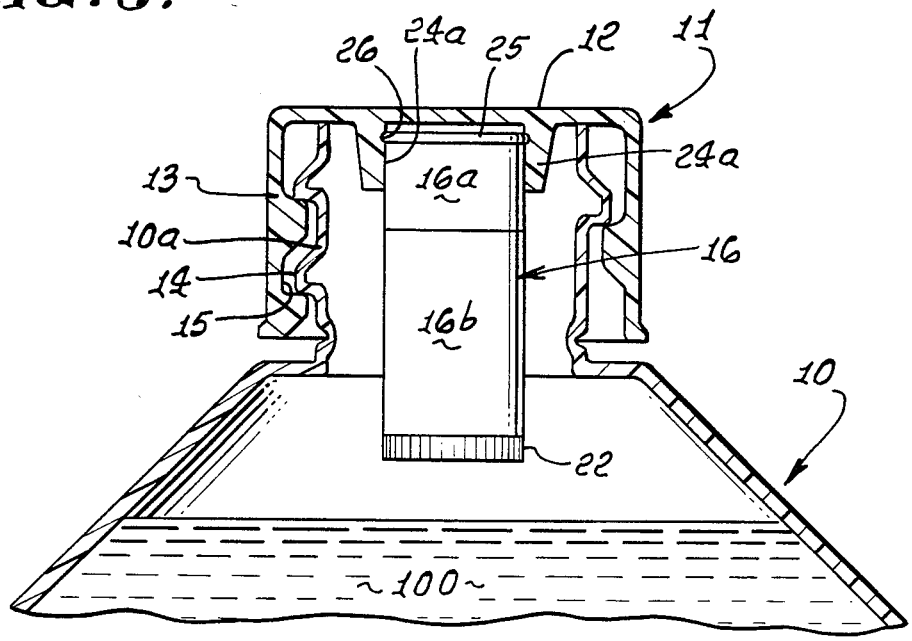
FIG. 3 is a section showing a fitment cap snapped into a friction sleeve in a bottle overcap.

In FIG. 3, the elements bearing the same numbers as in FIG. 1 are the same. The cap top wall 12 in addition has an integral sleeve 24*b* depending therefrom, within the bottle neck. The fitment cap 16*b* may extend telescopically into the sleeve bore 24*a*, and a flange 25 on the cap may removably snap into an annular recess 26 in the bore wall, as shown.

Figure 4:
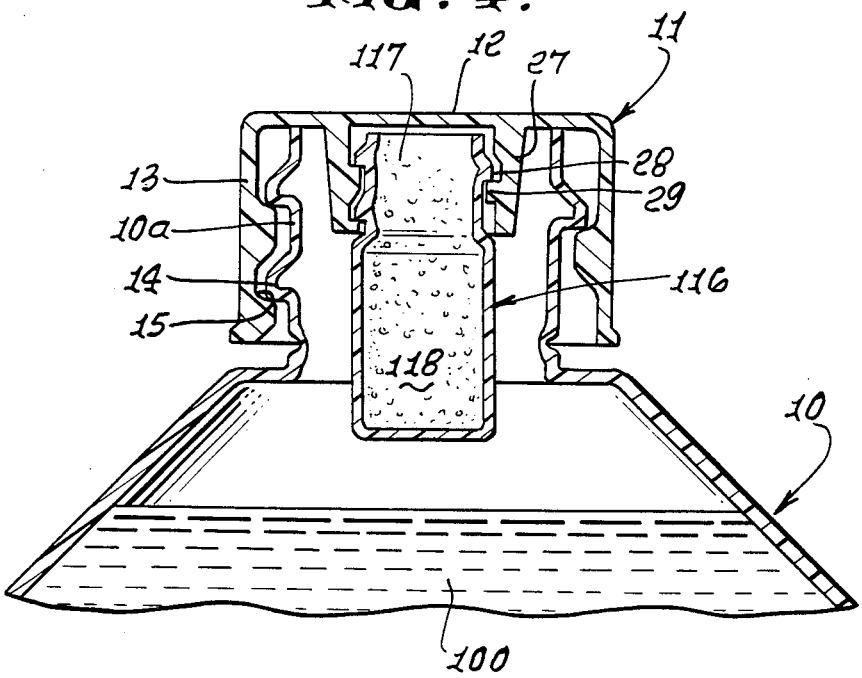
FIG. 4 is a section showing a fitment thread connected to a double threaded bottle overcap.
Figure 13:
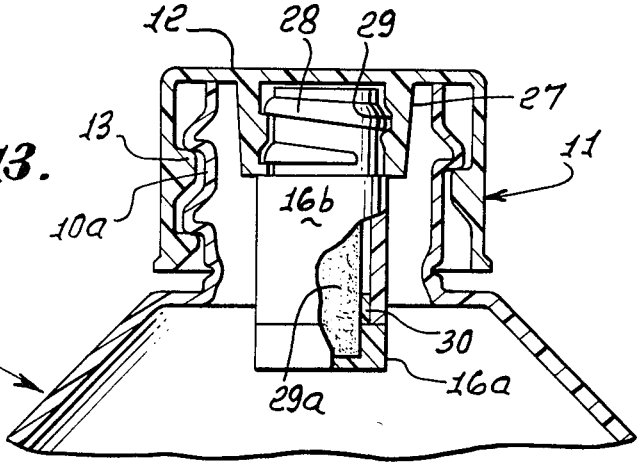
FIG. 13 is a section showing an inverted fitment thread connected into a double threaded overcap.

In FIG. 13, the elements bearing the same numbers as in FIG. 1 are the same. The cap top wall 12 in addition has an integral sleeve 27 depending therefrom, within the bottle neck. The fitment sub-container 16*b* in this embodiment has threaded connection with the sleeve 27, as afforded by threads 28 and 29. The fitment sub-container cap 16*a* is thus presented to the user. He may detach the cap 16*a* and pull the cap and a pre-spotter stick 29*a* completely free of the sub-container 16*b*. Both cap and sub-container frictionally interfit at 30, other methods of connection being usable. FIG. 4 is like FIG. 13 except the fitment 116 is in one piece and has an open top at 117, directly below wall 12. Fitment thread 28 engages sleeve thread 29. Prespotter granules in the fitment appear at 118.

Figure 15:
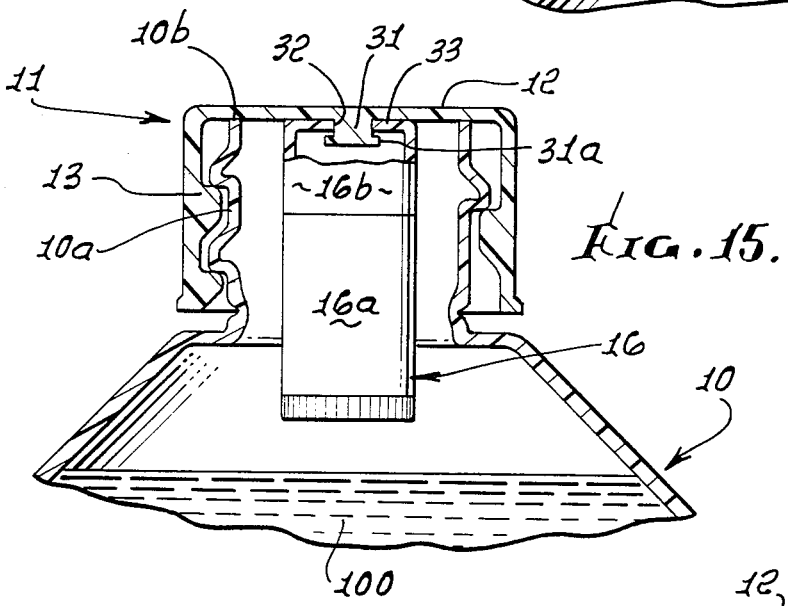
FIG. 15 is a section showing a fitment snap connected onto a plug in the bottle overcap.

In FIG. 15, the elements bearing the same numerals as in FIG. 1 are the same. The fitment cap 16*b* and the bottle cap top wall 12 include removably interfitting snap connection elements, as for example small flanged boss or plug 31 depending from top wall 12 and received through an opening 32 in the fitment cap top wall 33. Opening 32 is slightly smaller in diameter than the flange 31*a*, providing a snap-on interfits. Other forms of snap connection are usable.

Figure 12:
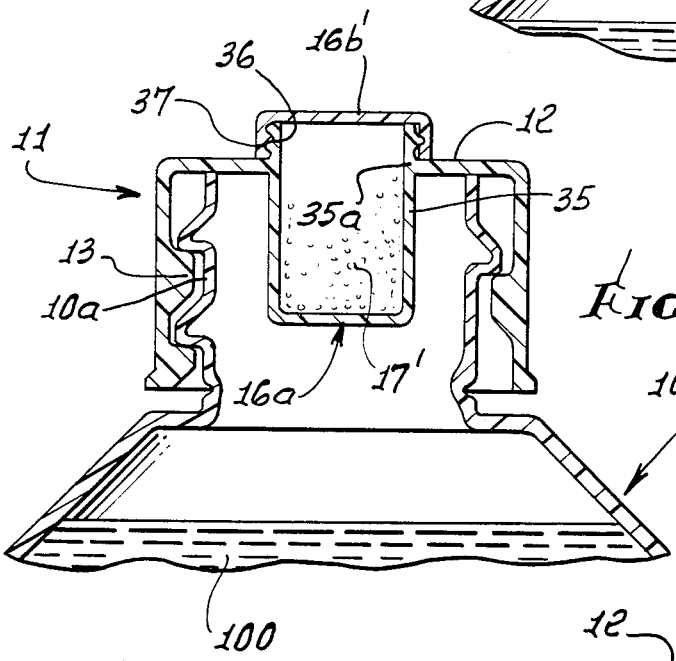
FIG. 12 is a section showing a fitment molded as an integral part of a bottle overcap.

In FIG. 12, the elements bearing the same numerals as in FIG. 1 are the same. The fitment sub-container 16*a* has a side wall 35 integrally molded with the bottle cap top wall 12, at 35*a*, and wall 35 projects and is externally threaded at the upper exterior side of the wall 12. Subcontainer cap 16*b*′ is internally threaded at 36 to engage the external thread 37 on wall 35, as shown. Thus, cap 16*b*′ is easily removable, exteriorly, to allow pouring or other dispensing of the prespotter 17′ which may be in liquid or flowable granules, or other form.

Figure 11:
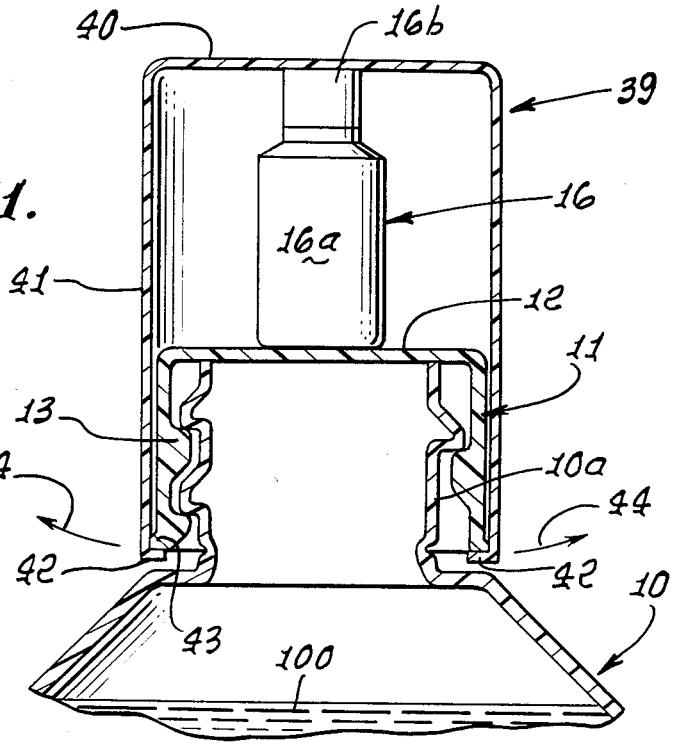
FIG. 11 is a section showing a fitment contained in a bottle snap-on overcap.

In FIG. 11, the fitment 16 is primarily (as for example completely) located outside and above the cap top wall 12, and auxiliary means is provided to retain the fitment in position, just above wall 12. In the example, such auxiliary means has the form of a thin-walled plastic overcap 39, having a top wall 40 located to compressively retain the fitment vertically between walls 40 and 12, as shown. The overcap depending skirt 41 is removably mounted on the bottle cap, so that it may be easily detached. As shown, two lips 42 engage the lower rim 43 of the cap 11, and may be pulled free (see arrows 44) to release the overcap, providing access to the fitment 16.

Figure 14:
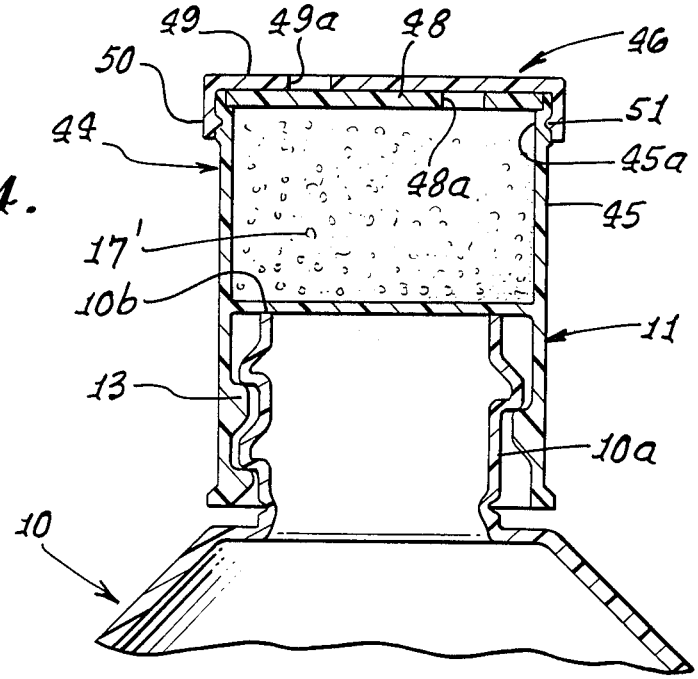
FIG. 14 is a section showing a fitment thread connected over the bottle finish, the fitment having a cap attached to a rotary dispensing closure.

In FIG. 14, the fitment 44 includes a sub-container 45 integral with the bottle cap 11, and extending thereabove. Sub-container cap structure 46 is connected to the sub-container 45, to allow dispensing of the flowable prespotter composition. As shown, the cap structure includes first and second walls 48 and 49, each containing ports 48*a* and 49*a* normally out of registration. The walls extend adjacent one another, and are relatively rotatable (i.e. wall 49 may rotate relative to wall 48, for example) to bring ports 48*a* and 49*a* into registration, allowing dispensing of prespotter. Wall 49 is shown as having a skirt 50 with annular detent connection at 51 to the sub-container wall 45*a*, allowing rotation of the skirt and wall 49. Flowable prespotter granules are indicated at 17′.

Figure 5:
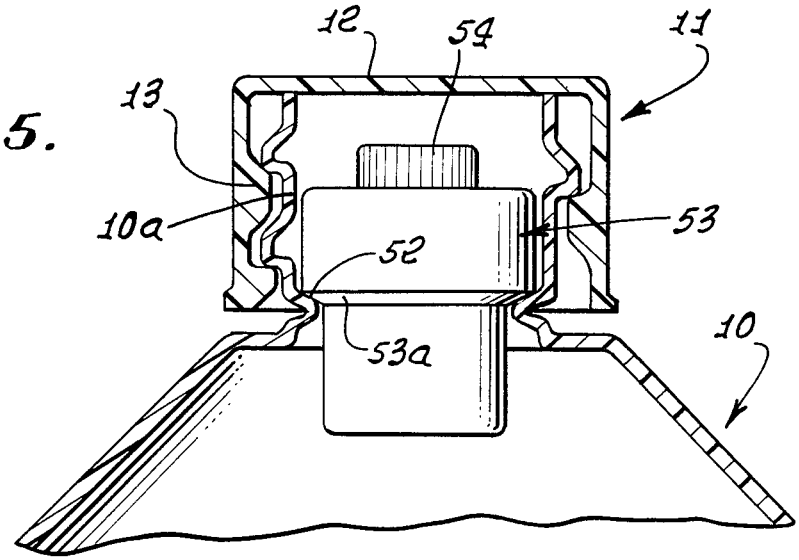
FIG. 5 is a section showing a fitment flange engaging an indent on a bottle neck.
Figure 6:
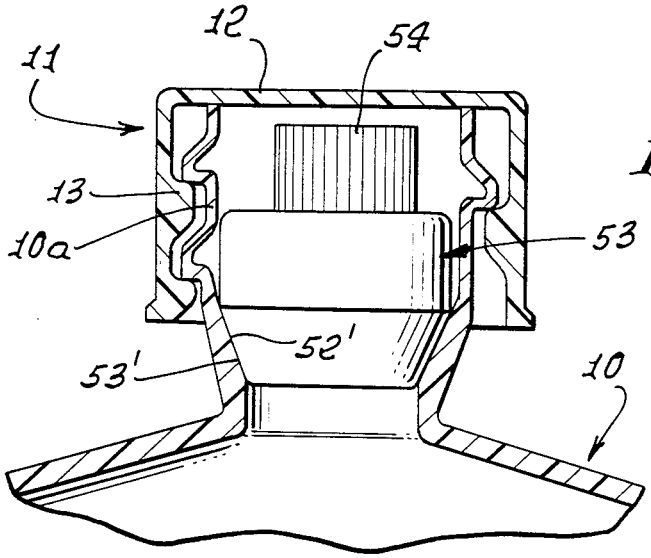
FIG. 6 is a section showing a tapered fitment wedged into a bottle tapered neck.

In FIG. 5, the bottle neck 10*a* has an internal ledge or ledges 52 seating the fitment sub-container 53. The latter has a flanged undersurface 53*a* engaging the ledge, which may be annular. In FIG. 6, the modified ledge 52′ tapers downwardly, and cooperatively engages or seats the frusto-conical outer surface 53′ of the fitment sub-container 53, to position the fitment. Caps for the fitment sub-container appear at 54 in FIGS. 5 and 6, and the fitments are loosely contained within the bottle neck to be completely removable when the bottle cap 11 is removed.

Figure 9:
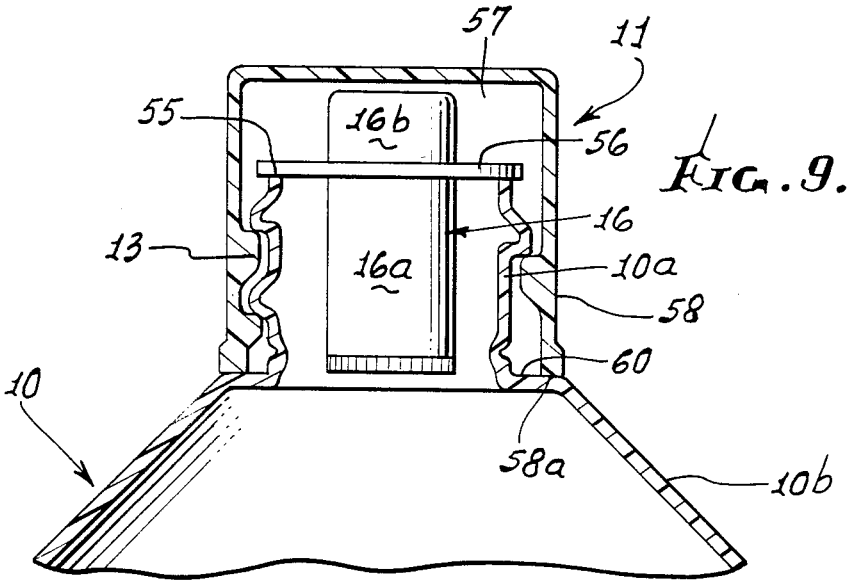
FIG. 9 is a section showing a collar under a fitment cap engaging a bottle sealing surface, and the bottle cap sealing on a bottle shoulder.
Figure 10:
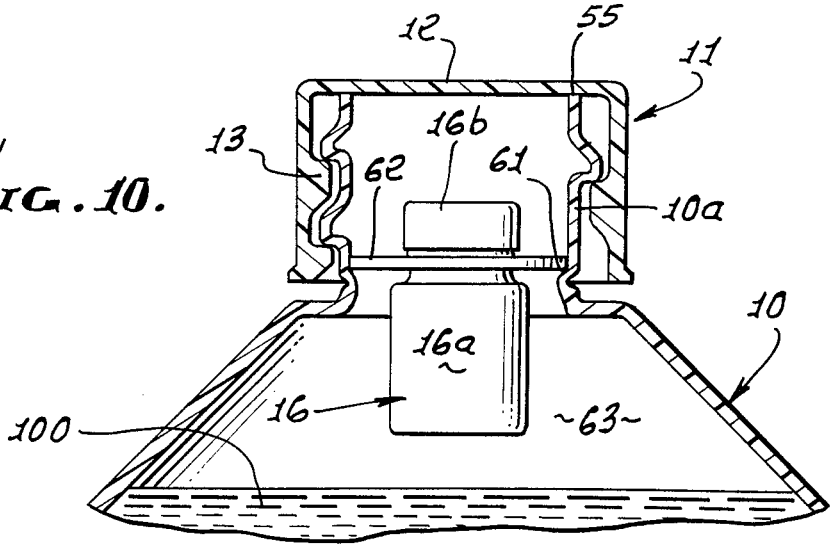
FIG. 10 is a section showing a collar under a fitment cap engaging an indent on a bottle neck.

In FIG. 9, the bottle neck 10*a* has an upper rim 55, and an external flange 56 on the fitment 16 seats on that rim to retain the fitment sub-container 16*a* within the neck 10*a*, and the sub-container cap 16*b* projecting upwardly within the cap upper interior 57. The lower edge or rim 58*a* of the cap skirt 58 seats and seals against the bottle shoulder 60 between neck 10*a* and bottle wall taper 10*b*. In FIG. 10, the bottle neck 10*a* has an internal integral flange or shoulder 61; and an external flange 62 on the fitment 16 seats on that flange 61. The flange is annular, and the fitment sub-container 16*a* projects downwardly through the flange into the bottle upper interior 63. Top wall 12 of cap 11 seats and seals on the upper rim 55 of the neck 10*a*.

Figure 8:
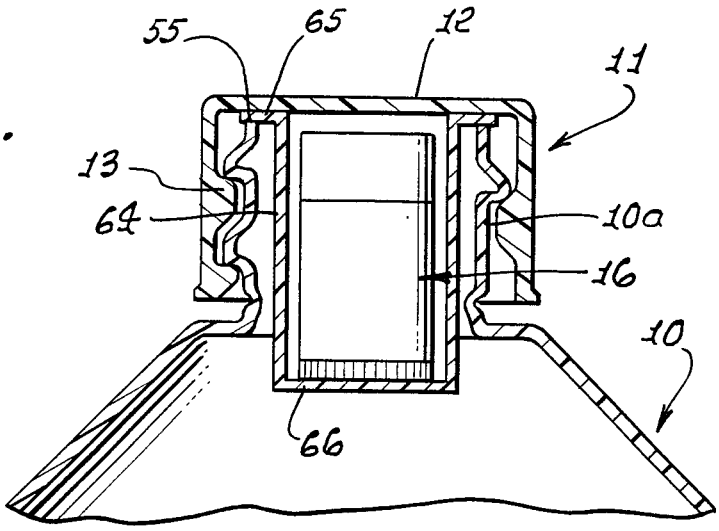
FIG. 8 is a section showing an inner prespotter container seated inside a flanged cup fitment which engages the top of the bottle finish.

In FIG. 8 a receptacle 64 has an external flange 65 seating on the bottle neck rim, and retained in position by the top wall 12 of the cap 11. The upwardly opening receptacle extends downwardly within the bottle neck 10*a*, and fitment 16 is loosely received in the receptacle, and confined between bottom wall 66 of the receptacle and top wall 12. Receptacle 64 is removable after cap 11 is removed.

Figure 7:
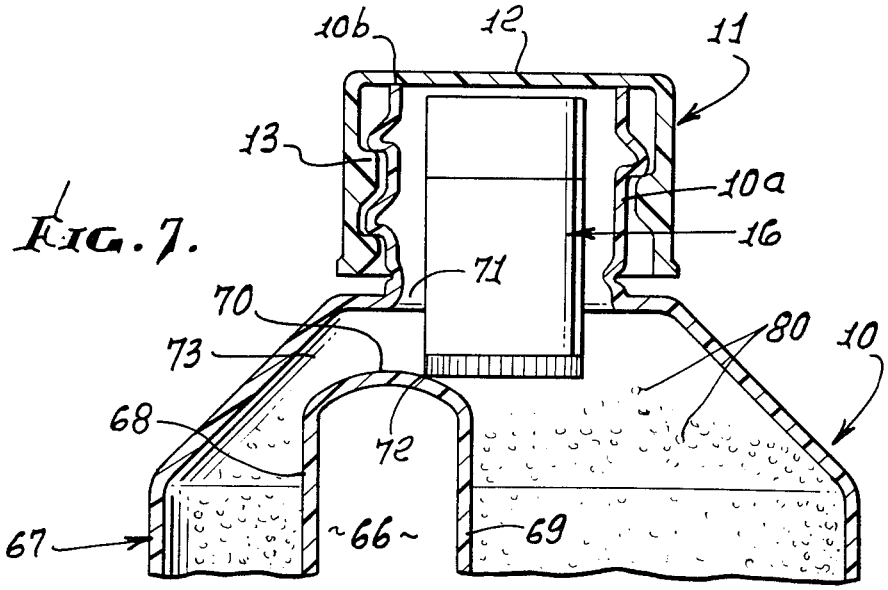
FIG. 7 is a section showing a fitment seated on a shelf formed in the bottle, as an indent or part of the bottle handle.
Figure 16:
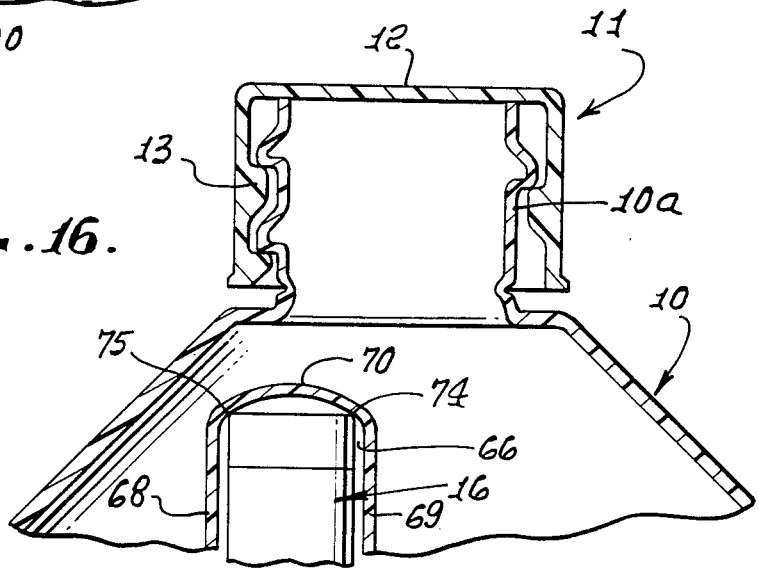
FIG. 16 is a section showing a fitment received within a recess formed in the bottle as an indent or handle.

In FIG. 7, the bottle 10 has side wall structure that forms a lateral hand reception opening 66 and a manually graspable handle 67 associated with that opening. The wall structure includes vertical walls 68 and 69, and wall upper portion 70 presented internally of the bottle and generally upwardly toward neck 10*a* and neck opening 71. The fitment 16 is seated at 72 on wall upper portion 70, within upper interior 73 of the bottle, and also extends upwardly into and within the neck opening 71, as shown. The fitment may be sufficiently large in diameter so as to be retained in position by the neck and by the wall portion 70. The opening 66 may be merely an indent, and other than associated with a handle. See also flowable detergent granules at 80, filling the bottle. In FIG. 16, the fitment 16 is received within the opening or indent 66, removably retained as by frictional engagement with the wall structure, as at points 74 and 75.

Figure 17:
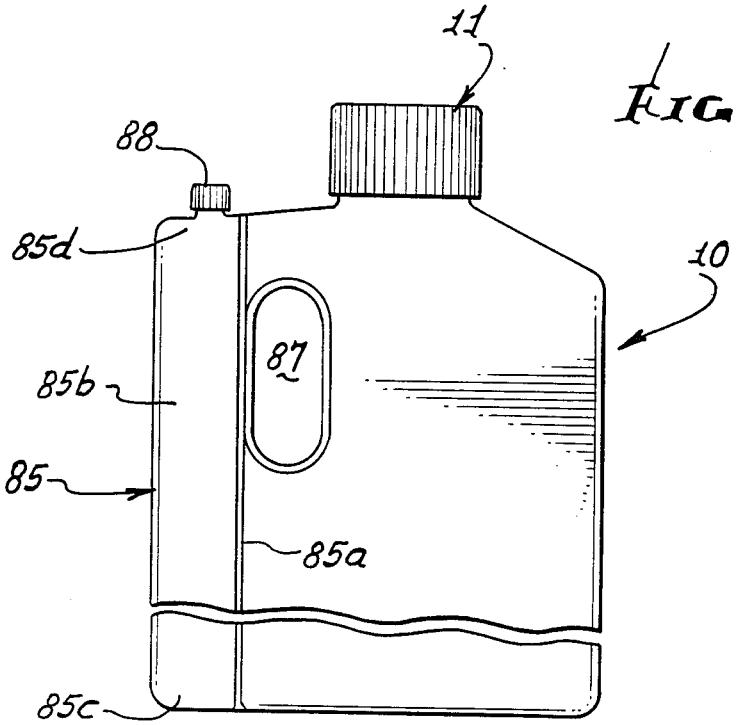
FIG. 17 is a vertical elevation showing a fitment molded as an integral part of a bottle, thereby forming a dual chambered container.

In FIG. 17, the fitment 85 extends externally of the bottle 10 and is attached thereto, as per example at the vertical location 85*a*, merging with the bottle side wall. Thus, the vertically elongated fitment may include a portion 85*b* forming a bottle handle associated with lateral opening 87 through the bottle for finger reception. The fitment is shown to extend upwardly from a location 85*c* near the bottom of the bottle to a location 85*d* near the top of the bottle. Fitment cap 88 is exposed externally of the bottle and its cap 11, and is offset laterally from cap 11, so that if cap 88 is removed, the flowable (liquid or dry) prespotter contents of the fitment container can be poured onto fabric to be washed, and if cap 88 is replaced and cap 11 removed, detergent can be poured into the wash water.

Figure 18:
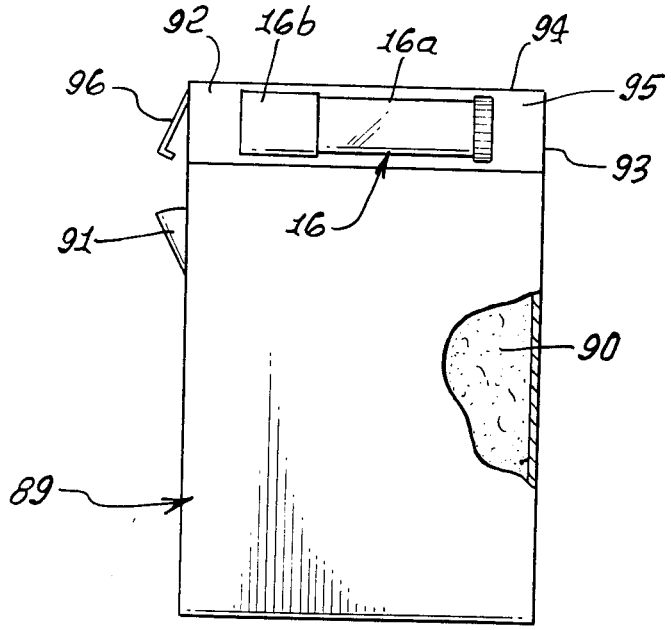
FIG. 18 is a vertical elevation, partly in section, showing a fitment contained in a separate compartment that is an integral part of a folding carton used to hold the detergent.

In FIG. 18, the carton 89 (as for example cardboard) contains detergent such as dry granules seen at 90. A pour spout appears at 91. The fitment 16 is carried in a separate compartment 92 defined by the carton, as for example by carton walls 93–95 at the top of the carton. A flap 96 is releasable to allow fitment removal.

PRESPOTTER

Prespotters in the form of liquids, powders, aerosols and sticks are known, and are designed to deliver a concentrated amount of effective stain removal ingredient to the stained or heavily soiled area of the garment. Common stain removal ingredients incorporated in laundry prespotter compounds are surfactants, solvents, bleaches, and enzymes. See in this regard U.S. Pat. No. 3,953,353 to Barrett et al, disclosing a stick form prespotter.

A. Surfactants

Surfactants are classed as anionics, nonionics, cationics, amphoterics and zwitterionics. The anionic and nonionic surfactants find the greatest utility in laundry prespotters. Suitable surfactants are described in "McCutcheon's Detergents and Emulsifiers 1982 Annual" and are listed by trade name and chemical type. Without going into great detail, the suitable anionic surfactants include organic sulfonates, sulfates, phosphate and phosphonates which contain hydrophilic as well as lipophilic groups. These include, for example, linear higher alkyl benzene sulfonates, higher olefin sulfonates, higher alkyl sulfonates, higher paraffin sulfonates, higher alcohol sulfates, the sulfates of condensations of higher alcohols and lower alkylene oxides, and the fatty acid soaps. The higher alkyl chain lengths will generally be from 12 to 18 carbons. The salt forming cations of these compounds are usually alkali metal cations, ammonium, amines or alkanolamines.

Nonionic surfactants useful in the prespotter product include all surface active agents possessing both lipophilic and hydrophilic groups which do not ionize in water. Suitable nonionic surfactants are the polyoxyalkylene alkylphenols wherein the hydrophobic group contains a phenolic nucleus having a substituent alkyl group of at least 4 but preferably 8–12 carbon atoms and the hydrophilic portion is composed of at least 3 but preferably 6–100 moles of ethylene oxide or propylene oxide per mole of alkylphenol.

Also, suitable nonionic detergents are the polyoxyalkylene alcohols wherein the hydrophobic group is derived from natural or synthetic primary or secondary straight chain fatty alcohols having about 8–22 carbon atoms and the hydrophilic group is composed of at least 3 but preferably 5–100 moles of ethylene oxide or propylene oxide.

Other suitable nonionics are the polyalkylene esters of the higher organic acids usually having 8 or more carbon atoms in the acid hydrophobe and 10 or more moles of ethylene oxide as the hydrophilic group.

Further suitable nonionics are the polyalkylene alkylamides having a hydrophobic group derived from an amide of a fatty acid or ester. Also, suitable are the polyalkylene alkylamines whose hydrophobic group is from a primary, secondary or tertiary amine and whose ethylene oxide content is sufficiently high to impact both water solubility and nonionic characteristics in neutral or alkaline environments.

A further class of suitable nonionics are the fatty acid esters of various polyols including glycols, glycerols, polyglycerol, hexitols and sugars and their polyoxyethylene condensates.

An additional group of suitable nonionic detergents are the polyalkylene oxide block copolymers made by condensing alkylene oxides with a hydrophobic base, itself obtained by condensing alkylene oxides with a reactive organic molecule.

Further suitable types of nonionic detergents include fatty alkanolamides, amine oxides, phosphine oxides, acetylenic glycols, and polyoxyethylene actylenic glycols.

B. Solvents

Numerous organic compounds have found use in prespotter formulations based on their ability to solubilize oily and greasy soils, and hydrocarbon based stains such as ink. These compounds differ from the surfactants in that their mode of action is a solvent effect as opposed to a surface tension reduction effect. These compounds include the lower mono, di and polyhydric alcohols, their alkyl or aryl ethers, their alkyl esters and their alkoxy derivatives. Examples are ethanol, isopropanol, ethylene glycol, glycerol triacetate, the Cellosolves[1] and the Carbitols.[1]

[1]Trademark of Union Carbide

Other compounds exhibiting desirable solvent properties are the lower hydrocarbons and their halogenated derivatives. Examples are pentane, hexane, decane, trichloroethane, perchloroethylene and carbon tetrachloride. Compounds of this type with sufficiently high vapor pressure often serve a dual function as the propellant in the aerosol products. Examples are propane, butane, and the Freons.[2]

[2]Trademark of E. I. duPont de Nemours & Co., Inc.

C. Enzymes

Enzymes find use in prespotter products in treating protein or starch based soils which are not readily removed by the other prespotter ingredients. The enzymes catalyze the breakdown of the soil into simpler compounds that can be washed away in the laundering process. Enzymes suitable for use in prespotters are well described in the patent literature and generally are alkaline or neutral pH stable proteinases and/or amylases. Examples are the Esperases and Termamyl enzymes manufactured by Novo Industries A/S of Copenhagen, Denmark and the Maxacal and Maxamyl enzymes manufactured by Gist-Brocades NV. of Delft, Holland.

D. Bleaches

Fabric safe bleaches and in particularly those bleaches that release nascent oxygen as the bleaching agent are suitable for use in a laundry prespotter. These compounds include both inorganic and organic peroxides. Examples of inorganic bleaching agents are sodium perborate, sodium percarbonate, hydrogen peroxide and potassium peroxymonosulfate. Examples of organic oxygen bleaches include monoperoxyphthalates, alkylbutanediperoxoic acids, and diperoxydodecanedioic acids.

E. Other Ingredients

Other compounds find use in laundry prespotters for aesthetic, stability, and physical reasons and not for their stain removal abilities. These could include perfume, fluorescent whitening agents, colorants, diluents, binders and fillers.

Examples of Prespotter Formulas

The following are examples of typical prespotter formulations which are usable:

I. The following is a solid prespotter composition suitable for melting and casting into sticks for use in a push-up or screw-up container, (weight percentages being indicated):
- 40% Igepal CO-630 (GAF's polyethoxylated nonylphenol)
- 30% Tergitol 15-S-40 (Union Carbide ethoxylated alcohol)
- 29% Carbowax 4000 (Union Carbide polyethylene glycol)
- 1% Esperase 4.0T (Novo Industries enzyme)

II. The following is an example of aerosol prespotter:
- 10% tetrachloroethylene
- 15% Neodol 23-6.5 (Shell ethoxylated alcohol)
- 70% $C_{10}$–$C_{16}$ hydrocarbon
- 5% isobutane (propellant)

III. An example of a suitable liquid prespotter is:
- 20% Neodol 23-6.5
- 15% Alfonic 1412-A (Conoco ether sulfate)
- 2% enzyme
- q.s. water, perfume, dye IV. Detergent The detergent composition (indicated for example at 10 in FIG. 1) can be any of those types currently well known in the laundry detergent art, including liquids and powders. The main purpose of the detergent is to provide soil removal; however, for this invention a multifunctional detergent product is the preferred embodiment. Additional available functions of the detergent compound are fabric softening, static prevention, bleaching, stain removal and/or whitening, bluing and water softening. Ingredients useful in preparing detergent products include: surfactants, builders, bleaching agents, soil suspending agents, optical brighteners, hydrotopes, dyes and perfumes, borax, enzymes, bluings, and anti soil redeposition agents.

Suitable surfactants for the detergent compound include those listed previously in the prespotter description. The preferred surfactants because of their cost, availability and performance are linear alkylbenzene sufonates, alkylsulfates, alkyl ether sulfates, alpha olefin sulfonates, fatty acid soaps, ethoxylated nonylphenols, the ethoxylated long chain alcohols and polyalkylene oxide block copolymers. The above surfactants can be formulated alone or in combination to achieve the desired soil removal performance.

Alkaline builders are often incorporated, especially in dry detergent formulations. These compounds are well known in the art and serve the purpose of overcoming water hardness and boosting detergency of the product. Suitable inorganic builder salts include pyrophosphates, tripolyphosphates, orthophosphates, carbonates, silicates, sesquicarbonate, bicarbonate, borates, zeolites and the like. Suitable organic builders include citrate, tartrate, gluconate, EDTA and NTA.

Unbuilt detergent compositions are common, especially in liquid forms. Effective performance is achieved by providing generally higher levels of surfactants or recommending higher useage levels.

Other components of detergent composition which may be included are dyes, perfumes, fillers and diluents which tend to improve the aesthetic and processing characteristics of the product.

In order to achieve a multifunctional product, one or more of the following can be added to the detergent composition: enzymes, bleach, fabric softener/antistat. Enzymes have been described elsewhere herein and are available in the form of prills or granules for addition to dry products and as liquids for addition to liquid detergent products. Stable enzyme products, either liquid or powder can be formulated by those skilled in the art.

A preferred embodiment of this invention includes a detergent in combination with a fabric softener/antistat. The combination of fabric softeners with unbuilt liquid detergents and low alkalinity dry detergent is known in the art. The incorporation of fabric softeners, especially the preferred quaternary ammonium compounds with highly alkaline built dry detergents, however, requires a novel approach. We have found that by absorbing the cationic softener onto a highly absorbent water soluble substrate and coating the resulting material with a finely divided solid to act as a barrier between the cationic and the alkaline builder, we can obtain a free flowing bead that when added to a dry detergent imparts effective softening/antistat properties without the stability problems previously associated with fabric softener/alkaline detergent mixtures. The fabric softener bead is composed of the following:

(a) from about 1% to about 90% by weight porous substrate such as puffed borax, dendritic salt, and clay (b) from about 0.5% to 75% by weight of a fabric softener mixture consisting of one or more of:

(1) from about 1% to 100% by weight of a material or mixture of materials known in the art to provide useful softening and/or antistatic effects on textiles, (usually alkyl quaternary ammonium or (imidazolinium compounds);

(2) optionally and preferably from about 1% to 100% by weight of a suitable solubilizing or dispersion aid admixed with (1). Such aids may be selected from groups consisting of nonionic surfactants, amphoteric, zwitterionic surfactants or fatty acid soaps;

(3) optionally and preferably from about 0.1 to about 25% by weight of a hardener such as a wax or high molecular weight polyethylene glycol, admixed with (1);

(c) from about 1% to about 30% by weight of a finely divided solid which provides an external coating on the bead, acts as a barrier, and removes tackiness. Such a solid is selected from the group consisting of amorphous silica, starch, inorganic salts, and other anti-tacky material that dissolve in wash water.

The beads are manufactured in a suitable mixer preferably one which provides gentle agitation. The substrate material is charged into the mixer and the softener mixture applied. Once all of the substrate is coated with the softener mixture, the finely divided solid is charged to the mixer in an amount sufficient to coat the beads and make them free flowing.

The finished fabric softener beads may then be added to any dry detergent. The detergent may be spray dried, dry mixed or agglomerated. It may contain anionic, nonionic, amphoteric or zwitternionic surfactants or mixtures thereof. It may also include one or more of the auxiliary ingredients previously mentioned.

Suitable fabric softening/antistat compounds are the quaternary ammonium compounds of the following structure,

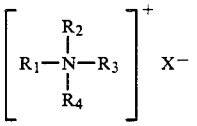

where $R_1$ represents an aliphatic group of from 1 to 22 carbons, or hydrogen; $R_2$ represents an aliphatic group of from 12 to 24 carbon atoms, $R_3$ and $R_4$ represent alkyl groups of from 1 to 3 carbon atoms; X represents an anion selected from the group consisting of halogen, sulfate, methyl sulfate, phosphate, nitrate and acetate.

Other suitable fabric softening/antistat compounds are the quaternary imidazoline compounds of the following structure,

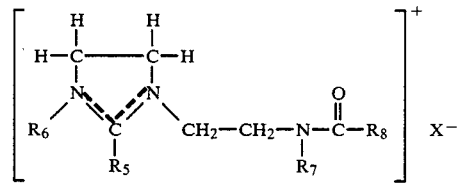

where $R_5$ represents an aliphatic group of from 1 to 22 carbon atoms or hydrogen; $R_6$ represents an alkyl group of from 1 to 4 carbon atoms; $R_7$ represents an alkyl group of from 1 to 4 carbon atoms or hydrogen; and $R_8$ represents an aliphatic group of from 8 to 24 carbon atoms; and X is an anion as mentioned previously.

Other useful quaternary ammonium compounds include dimethyl alkyl benzyl chlorides, complex diquaternary chlorides, diamidoamine based methyl sulfates and other various other quaternary derivatives.

Examples of Detergent Formulas

While many possible detergent formulas are usable for this invention, the following examples are typical detergent formulations are typical of those that can be used with highly advantageous results:

I Liquid Detergent/Fabric Softener
- 5% sodium linear dodecylbenzene sulfonate
- 10% nonylphenol ethoxylate
- 5% sodium xylene sulfonate
- 3% cationic fabric softener
- q.s. water, perfume, dye II Liquid Detergent/Enzyme
- 20% ethoxylated lauryl alcohol
- 15% ethoxylated alcohol sulfate
- 2% protease enzyme
- q.s. water, perfume, dye III Dry Detergent/Enzyme
- 15% sodium linear alkyl benzene sulfonate
- 10% sodium silicate
- 25% sodium tripolyphosphate
- 1% Esperase 4.0T enzyme
- 0.1% perfume
- 0.05% fluorescent whitening agent
- q.s. sodium sulfate IV Dry Detergent/Bleach/Enzyme/Fabric Softener
- 15% sodium silicate
- 22% fabric softener bead*
- 6% sodium percarbonate
- 31% sodium carbonate
- 10% sodium chloride
- 4% ethoxylated nonylphenol
- 1% protease enzyme
- 1% Sipernat 50-S

*Fabric Softener Bead: 50% puffed borax; 30% ethoxylated nonylphenol; 10% ditallow dimethyl quaternary ammonium chloride; 10% Sipernat 50-S (amorphous silica)

In the above, the indicated percentages are approximate and by weight.

The subject matter of Deborah Winetzky U.S. Patent application Ser. No. 596,037, entitled "Porous Substrate with Adsorbed Antistat or Softener, Used with Detergent", filed contemporaneously herewith, is incorporated by reference.

From the above, it will be understood that the detergent composition as at 100 is in flowable form, and is characterized as having soil removal properties as well as having one or more of the following properties or capabilities:

fabric softening
antistat
enzymatic dissolution of protein and/or carbohydrate bound soils
bleaching
fabric whitening
water softening
soil suspending or suspension It will also be understood that the bottle, as at 10 and/or 10a, may have a transparent (glass, plastic, etc.) side wall, and that the fitment dispensing container (as for example at 16) may extend within the bottle to an extent such that the dispensing container can be seen sidewardly through the bottle side wall. In this regard, the dispensing container may also have a transparent side wall (16*a* for example) whereby the prespotter composition can also be seen through both such transparent side walls.

We claim:

1. In the method of laundering fabric, the steps that include:

(a) providing a first volume of detergent a portion of which is to be added to fabric laundry wash water,
(b) providing a second and smaller volume of a prespotter composition in close transported association with said first volume of detergent for presentation at the time of laundering,
(c) and separating some of said prespotter composition from said close association with the detergent volume and applying same to a soiled portion or portions of fabric that is thereafter laundered in said wash water containing said added portion of detergent,
(d) said first volume of detergent being provided in a relatively large container, provided with a neck,
(e) said prespotter composition being provided in a fitment substantially smaller than said relatively large container,
(f) said (b) step including locating the fitment in the relatively large container, via said neck,
(g) and gaining access to the fitment in the large container and via said neck so that prespotter composition may be dispensed, and at the time of also gaining access to the detergent in the large container, via said neck prior to said step (c) application.

2. The method of claim 1 including:

(i) providing said neck at the top of said relatively large container containing said first volume of detergent,
(ii) providing a sub-container containing said smaller volume of prespotter composition, and
(iii) mounting said sub-container on said neck in close transported association with said container.

3. The method of claim 2 wherein said (iii) step includes mounting the sub-container in transported relation to the container as defined in claim 1, for presentation to the user of the detergent at the time of laundering.

4. The method of claim 1 including incorporating beads admixed with the detergent and useful in a fabric aqueous laundering process to impart to the fabric, when dried, at least one of the properties (i) softness, and (ii) antistatic effect, each bead comprising (a) a porous substrate,
(b) and substance absorbed into said substrate to produce at least one of said (i) and (ii) properties in the fabric.

5. The method of claim 4 including a barrier layer formed about said bead substrate and absorbed substance and characterized as dispensing in laundry wash water, and allowing said barrier layer to so disperse in the wash water.

6. The method of claim 5 wherein the bead substrate is selected from the group that consists of puffed borax, dendritic salt, and clay.

7. The method of claim 5 including a solubilizing or dispersion aid mixed with said substance and also absorbed into the the bead substrate.

8. The method of claim 5 including a hardener mixed with said substance and also absorbed into the bead substrate.

9. The method of claim 7 including a hardener mixed with said substance and aid, and also absorbed into the bead substrate.

10. The method of claim 6 wherein said substance is cationic.

11. The method of claim 6 wherein said substance comprises a material selected from the group consisting of quaternary ammonium compounds and imidazolinimum compounds.

12. The method of claim 7 wherein said solubilizing or dispersion aid is selected from the group consisting of ($x_1$) ampholytic surfactants which contain both anionic and cationic moieties,
($x_2$) Zwitterionic surfactants which also contain both anionic and cationic moieties,
($x_3$) fatty acid soap.

13. The method of claim 5 wherein said barrier layer is water soluble and is selected from the group that includes amorphous silica, inorganic salts, starch and powdered dyes.

14. The method of claim 4 wherein between about 1% and 90% of the bead weight is defined by the substrate and between about 5.0% and 75% of the bead weight is defined by said substance.

15. The method of claim 9 wherein between 1% and 90% of the bead weight is defined by the substrate and between about 0.5% and 75% of the bead weight is defined by said substance, and said mix consists of from about 1% to 100% by weight of said substance, from about 1% to 100% by weight of said solubilizing or dispersion aid, and from about 0.1% to 100% by weight of said hardener.

16. The method of claim 14 including from about 1% to about 30% by weight of a barrier layer in finely divided solid form extending about said substrate and absorbed substance and characterized as dispersing in laundry wash water.

17. The method of claim 15 including from about 1% to about 30% by weight of a barrier layer in finely divided solid form extending about said substrate and absorbed substance and characterized as dispersing in laundry wash water.

18. The method of any one of claims 4–17 wherein multiple beads as defined are admixed with dry laundry detergent.

19. The method of claim 1 including providing said container with a transparent wall via which said fitment can be seen in the container neck from the exterior.

20. The method of claim 1 including (d) adding said detergent portion and fabric to the wash water in a washing machine and initiating operation of said machine to launder the fabric, said (c) step carried out just prior to said addition of the fabric to the wash water.

* * * * *